US009061338B2

(12) United States Patent
Shulkin et al.

(10) Patent No.: US 9,061,338 B2
(45) Date of Patent: Jun. 23, 2015

(54) APPARATUS AND METHOD FOR FORMING SHAPED ARTICLES FROM PLURAL SHEET METAL BLANKS

(75) Inventors: Boris Shulkin, West Bloomfield, MI (US); William A. Kokosza, Windsor (CA)

(73) Assignee: MAGNA INTERNATIONAL INC., Aurora (CA)

( * ) Notice: Subject to any disclaimer, the term of this patent is extended or adjusted under 35 U.S.C. 154(b) by 193 days.

(21) Appl. No.: 13/993,226

(22) PCT Filed: Dec. 16, 2011

(86) PCT No.: PCT/CA2011/001374

§ 371 (c)(1),
(2), (4) Date: Jun. 11, 2013

(87) PCT Pub. No.: WO2012/079156

PCT Pub. Date: Jun. 21, 2012

(65) Prior Publication Data

US 2013/0276499 A1 Oct. 24, 2013

Related U.S. Application Data

(60) Provisional application No. 61/424,350, filed on Dec. 17, 2010.

(51) Int. Cl.

| | |
|---|---|
| ***B23P 17/00*** | (2006.01) |
| ***B21D 26/021*** | (2011.01) |
| ***B21D 26/047*** | (2011.01) |
| ***B21D 26/055*** | (2011.01) |
| *B21D 26/02* | (2011.01) |

(52) U.S. Cl.

CPC ..... *B21D 26/021* (2013.01); *B21D 26/02* (2013.01); *B21D 26/047* (2013.01); *B21D 26/055* (2013.01)

(58) Field of Classification Search

CPC .... B21D 26/02; B21D 26/021; B21D 26/047; B21D 26/055

See application file for complete search history.

(56) References Cited

U.S. PATENT DOCUMENTS 2,949,875 A * 8/1960 Adams ..... 72/61
3,920,175 A 11/1975 Hamilton et al.

(Continued)

FOREIGN PATENT DOCUMENTS

JP 7001050 A 1/1995
JP 2003/164924 A 6/2003

OTHER PUBLICATIONS

International Search Report dated Mar. 27, 2012 in corresponding International Application No. PCT/CA2011/001374.

*Primary Examiner* — David B Jones

(74) *Attorney, Agent, or Firm* — The Law Office of Michael E. Kondoudis

(57) ABSTRACT

An apparatus and method are provided for the simultaneous forming of a plurality of shaped articles from plural sheet metal blanks. First and second sheet metal blanks are arranged between upper and lower forming dies, and a nozzle body having a generally diamond-shaped cross-sectional profile, transverse to an insertion direction, is inserted between the sheet metal blanks. When the forming tool is closed, upper and lower sealing surfaces of the nozzle body press the first and second sheet metal blanks, respectively, against sealing beads that are arranged one each within peripheral areas of the upper and lower forming dies. Opposite side edges of the nozzle body converge one toward the other so as to facilitate forming a seal along each of the side edges of the nozzle body. A pressurized fluid is introduced via the nozzle body for forming the sheet metal blanks within a die cavity.

25 Claims, 6 Drawing Sheets

(56) References Cited

U.S. PATENT DOCUMENTS

| | | | |
|---|---|---|---|
| 6,266,986 | B1 | 7/2001 | Morita et al. |
| 6,301,765 | B1 | 10/2001 | Arns et al. |
| 6,341,515 | B2 | 1/2002 | Huber et al. |
| 6,675,621 | B2 | 1/2004 | Kleber |
| 6,694,790 | B2 | 2/2004 | Ryntz |
| 2003/0046966 | A1 | 3/2003 | Kleber |

* cited by examiner

APPARATUS AND METHOD FOR FORMING SHAPED ARTICLES FROM PLURAL SHEET METAL BLANKS

FIELD OF THE INVENTION

The invention relates generally to the forming of shaped articles from sheet metal blanks, and more particularly to an apparatus and method for the simultaneous forming of a plurality of shaped articles from plural sheet metal blanks.

BACKGROUND OF THE INVENTION

Superplastic metallic alloys, such as for instance certain fine grain alloys of aluminum, magnesium, stainless steel and titanium, are relatively ductile materials that can undergo substantial tensile deformation in the presence of low shaping forces. After being heated to a suitable forming temperature, these materials become capable of being stretched and formed over a forming tool and/or into a die cavity to make complex shaped parts, e.g., automotive body parts, or the like. This process often is referred to as superplastic forming.

In the superplastic forming (SPF) process, a sheet metal blank is positioned with one side lying close to the hot forming surface of a heated forming tool in a press. The metal sheet is often preheated to its forming temperature, and is gripped at its peripheral edges between complementary opposing dies. A pressurized fluid, such as for instance air, is applied to the other side of the sheet metal blank, thereby forcing and stretching it into conformance with the forming surface of one die while at the same time maintaining a target strain rate for deforming the sheet throughout the forming cycle. The superplasticity of the material enables forming of complex components that cannot be formed by conventional room temperature metal forming processes. For instance, use of the SPF process enables the forming of a workpiece with a deep cavity or with a cavity that is formed over very small radii. Further, superplastic forming often permits the manufacture of large single parts that cannot be made by other processes, such as for instance sheet metal stamping. In fact, a single part that is formed using the SPF process can sometimes replace an assembly of several parts that are made from non-superplastic forming materials and processes.

Due to the high pressures and temperatures that are employed in the SPF process, special attention must be paid to creating an effective gas-tight seal between the surfaces of the forming apparatus and the sheet metal blank. Typically, the upper and lower dies of the forming apparatus are moved together such that they press in opposite directions against the peripheral edges of the sheet metal blank. Specialized sealing features are often located on the dies in order to ensure that adequate sealing is achieved even when the temperature of the forming apparatus is raised and the shape of the dies may change. In contrast, forming processes that are carried out at lower temperatures typically do not require elaborate measures to ensure a gas-tight seal, since the tool parts are not heated to temperatures that are high enough to induce shape changes therein.

A common feature of many of the known SPF systems is that only one sheet metal blank at a time undergoes superplastic forming. In these systems, the pressurized gas is introduced via a passageway that is defined through one tool half, so as to cause the sheet metal blank to stretch and conform to the heated forming surfaces of the other tool half. This arrangement facilitates the formation of a gas-tight seal all the way around the periphery of the sheet metal blank, such that gas leakage is readily prevented. Unfortunately, the SPF process has a relatively long cycle time. Further, a considerable amount of energy is required in order to maintain the forming dies at the SPF process temperature. The combination of long cycle time and high energy usage makes it considerably more expensive to form parts using the SPF process compared to other processes, and therefore the SPF process has generally been limited to low volume and/or high value applications. That being said, the SPF process could be used to good advantage in a wide variety of other applications, if the low production rate and high cost issues are resolved.

One approach that has been investigated involves the simultaneous forming of two sheet metal blanks so as to produce two parts during each SPF cycle. Optionally, the two parts are identical or the two parts are different. This approach not only increases the part production rate, but it also reduces the amount of energy that is consumed in heating the dies on a per-part basis. Unfortunately, the simultaneous forming of two sheet metal blanks generally requires a more complex system for introducing the pressurized gas. In particular, it is necessary to introduce the gas into a region between the facing surfaces of the sheet metal blanks, while at the same time creating and maintaining a peripheral gas-tight seal between the two sheet metal blanks, even under conditions of high temperature and high internal pressure.

U.S. Pat. No. 6,694,790 in the name of Ryntz et al. discloses a system for the superplastic forming of parts from plural sheets. Ryntz et al. teaches a mid-plate assembly, in which a frame-shaped mid-plate is disposed between two blanks in a forming die. During use the mid-plate spaces apart the two blanks, so as to create a cavity therebetween. A lower tool having a sheet-piercing nozzle is configured such that the nozzle seats into the mid-plate to form a gas connection for supplying pressurized gas into the cavity between the blanks via a passageway that is defined through the mid-plate. This system is somewhat complicated and requires the use of a cumbersome mid-plate in addition to the standard components of a traditional superplastic forming apparatus. Further, the presence of the mid-plate creates an additional interface that must be sealed gas-tight, and there are additional maintenance issues relating to the sheet-piercing nozzle, etc.

U.S. Pat. No. 6,675,621 in the name of Kleber discloses another system for the superplastic forming of parts from plural sheets. According to Kleber, forming dies are moved to a closed position on each of a pair of stacked blanks so that a partial perimeter gas seal is established therebetween. A pressure wedge is then introduced between the two blanks along one edge of the pair, so as to act as a stopper or air seal to complete perimeter sealing. The pressure wedge also establishes the operative position of a gas injection port, which directs pressurized air interiorly of the completed perimeter seal of the pair of blanks. However, this system requires the use of unequal, oversized sized blanks and it does not appear to be readily adaptable to forming parts of different widths. Further, the system disclosed by Kleber does not appear to address formation of a gas-tight seal at the edges of the pressure wedge.

It would be beneficial to provide a system and method for forming composite articles from prepregs, which overcome at least some of the above-mentioned limitations of the prior art.

SUMMARY OF THE INVENTION

According to one aspect, the invention is directed to an apparatus for forming first and second shaped articles from first and second sheet metal blanks, comprising: a first die having first forming surfaces for forming the first shaped article from the first sheet metal blank and having a first seal bead disposed along an edge region surrounding said first forming surfaces, the first seal bead for peripherally sealing between the first die and the first sheet metal blank, the first die having a first recess defined in the edge region thereof, the first seal bead extending along a first surface through the first recess; a second die having second forming surfaces for forming the second shaped article from the second sheet metal blank and having a second seal bead disposed along an edge region surrounding said second forming surfaces, the second seal bead for peripherally sealing between the second die and the second sheet metal blank, the second die having a second recess defined in the edge region thereof, the second seal bead extending along a second surface through the second recess; and a nozzle body having a conduit extending therethrough for conducting an expansion fluid through said nozzle body, the nozzle body shaped for being received within a channel that is formed when the first die and the second die are brought together into a closed condition such that the first recess and the second recess are aligned one with the other, said nozzle body having first and second sealing surfaces that are joined along opposite side edges of said nozzle body, said opposite side edges converging one toward the other along an insertion direction of said nozzle body, wherein the channel is shaped such that, when the nozzle body is inserted along the insertion direction to a sealing position within the channel, the first seal bead forms a seal between the first sheet metal blank and each side edge of said nozzle body, and the second seal bead forms a seal between the second sheet metal blank and each side edge of said nozzle body.

According to another aspect, the invention is directed to an apparatus for forming first and second shaped articles from first and second sheet metal blanks, comprising: a nozzle body having an upper sealing surface and a lower sealing surface, the upper and lower sealing surfaces being joined along opposite side edges of said nozzle body, the opposite side edges converging one toward the other along an insertion direction of said nozzle body, said nozzle body having a conduit extending therethrough for conducting an expansion fluid through said nozzle body; and a pair of dies, each die of said pair of dies having part forming surfaces and having a seal bead disposed along an edge region surrounding said forming surfaces, the seal bead of one of said dies being offset relative to the seal bead of the other of said dies, the one of said dies having a first recess defined in the edge region thereof and the other of said dies having a second recess defined in the edge region thereof, the seal bead of the one of said dies extending along a surface through said first recess and the seal bead of the other of said dies extending along a surface through the second recess, said dies being relatively moveable between opened and closed positions with respect to one another, and said first recess being aligned with said second recess such that, in the closed position, the first recess and the second recess cooperate to form a channel for receiving said nozzle body, said channel having opposite edges, each opposite edge of said channel extending along a seam that is defined between the surface of the first recess and the surface of the second recess, the opposite edges of said channel converging one toward the other along the insertion direction of said nozzle body, wherein, during use, said nozzle body is disposed between said first and second sheet metal blanks within said channel, the seal bead of the one die forming a seal between the first sheet metal blank and the upper sealing surface of said nozzle body, and the seal bead of the other die forming a seal between the second sheet metal blank and the lower sealing surface of said nozzle body, and wherein, during use, the seal bead of the one die forms a seal between the first sheet metal blank and each side edge of said nozzle body, and the seal bead of the other die forms a seal between the second sheet metal blank and each side edge of said nozzle body.

According to another aspect, the invention is directed to a method for forming first and second shaped articles from first and second sheet metal blanks, comprising: arranging the first sheet metal blank on a lower die of a forming tool, such that a peripheral region of the first sheet metal blank contacts a first seal bead that extends around an edge surface of the lower die, and such that the first sheet metal blank overlaps with a first recess defined within the edge surface of the lower die; positioning a nozzle body above the first sheet metal blank and in alignment with the first recess; arranging the second sheet metal blank on top of the first sheet metal blank; closing the forming tool, comprising relatively moving an upper die of the forming tool in a direction toward the lower die, such that a second seal bead that extends around an edge surface of the upper die contacts a peripheral region of the second sheet metal blank, and such that a second recess defined within the edge surface of the upper die is aligned with the first recess of the lower die, the first recess and the second recess cooperating to form a channel for receiving the nozzle body; applying a tonnage to the upper and lower dies, so as to conform the first and second sheet metal blanks against opposite sealing surfaces of the nozzle assembly within the channel; advancing the nozzle body along an insertion direction between said first and second sheet metal blanks; introducing pressurized fluid via a conduit that is defined through said nozzle body and into a space between the first and second sheet metal blanks; and forming the first and second shaped articles simultaneously, under superplastic forming conditions, by forcing the first and second sheet metal blanks against forming surfaces of the upper and lower dies, respectively; wherein said first and second seal beads are offset one from the other, said nozzle body has first and second sealing surfaces that are joined along opposite side edges thereof, said opposite side edges converging one toward the other along the insertion direction, and the channel is shaped such that, when the nozzle body is inserted into the channel along the insertion direction, the first seal bead forms a seal between the first sheet metal blank and each side edge of said nozzle body, and the second seal bead forms a seal between the second sheet metal blank and each side edge of said nozzle body.

BRIEF DESCRIPTION OF THE DRAWINGS

The instant invention will now be described by way of example only, with reference to the attached drawings, wherein similar reference numerals denote similar elements throughout the several views, and in which.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1:
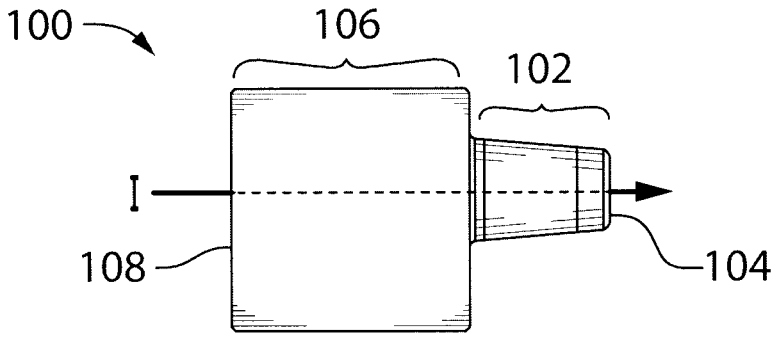
FIG. 1 is a side plan view showing a nozzle body according to an embodiment of the instant invention.

Shown in FIG. 1 is a side plan view of a nozzle body 100 according to an embodiment of the instant invention. The nozzle body 100 includes a sealing portion 102 that extends to a front face 104, and a support portion 106 that defines a rear face 108 of the nozzle body 100. The sealing portion 102 tapers with increasing distance away from the support portion 106, and has the appearance of a frustum in side plan view. An insertion direction "I" of the nozzle body 100 is indicated in FIG. 1, along which direction the nozzle body 100 is inserted between plural sheet metal blanks in a forming tool, as described in greater detail below.

In the specific and non-limiting example that is shown in FIG. 1, the sealing portion 102 is formed by a process of machining a block of a suitable material, such as for instance steel or another suitable material. As such, in the embodiment that is shown in FIG. 1 the material properties of the sealing portion 102 are continuous with the material properties of the support portion 106. Optionally, the sealing portion 102 and support portion 106 are fabricated separately and then joined together using a suitable technique, such as for instance by welding.

The support portion 106 provides a bearing surface of the nozzle body 100, such as for instance rear face 108, against which a force is applied during use in order to press the sealing portion 102 into a sealing engagement with features of the forming tool. Of course, the length of the support portion 106 relative to the length of the sealing portion 102, as measured along the insertion direction "I," may be varied. For instance, optionally a plate-like structure is provided instead of the block-like sealing portion 106 that is shown in FIG. 1. In such a case, it is necessary only that the plate-like structure has sufficient strength to resist deformation when the force is applied during use. Optionally, the nozzle body 100 is formed with a generally diamond-shaped rear face, such that the enlarged block-like or plate-like structure is omitted entirely. In this latter case, the diamond-shaped rear face of the sealing portion 102 defines the support portion 106, to which a plurality of rods or another similar structure may be attached for supporting the application of force as described above.

Figure 2:
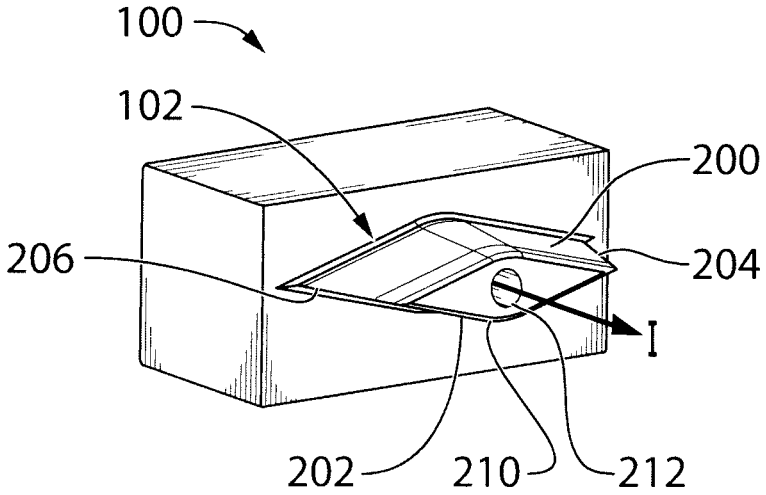
FIG. 2 is a perspective view showing the nozzle body of FIG. 1.

FIG. 2 is a perspective view showing the nozzle body 100 of FIG. 1. As is shown in FIG. 2, the sealing portion 102 is generally diamond-shaped when viewed along the insertion direction, and it includes a first sealing surface 200 and a second sealing surface 202. The first sealing surface 200 and the second sealing surface 202 are joined along opposite side edges 204 and 206 of the nozzle body 100. A spacing between the first sealing surface 200 and the second sealing surface 202 increases from a minimum spacing value along each of the side edges 204 and 206, to a maximum spacing value approximately half-way between said opposite side edges. In this example the side edges 204 and 206 are not knife-edges, but rather a small radius is formed along each side edge 204 and 206. Further, the first sealing surface 200 and the second sealing surface 202 are smoothly curved along the indicated surface portions 208 and 210, respectively, which are located approximately half-way between said opposite side edges 204 and 206. As described in greater detail below, the curved surface portions 208 and 210 facilitate sealing when the nozzle body 100 is inserted between plural sheet metal blanks in a forming tool.

Referring now to FIG. 1 and FIG. 2, the first and second sealing surfaces 200 and 202 taper one toward the other along the insertion direction "I." As a result, the perimeter of the diamond-shaped sealing portion 102 is smallest at the front face 104 and increases progressively along a direction toward the support portion 106. Since the first and second sealing surfaces 200 and 202 also taper toward the side edges 204 and 206, the side edges 204 and 206 converge one toward the other along the insertion direction "I." The pair of converging sealing surfaces 200 and 202, and the pair of converging side edges 204 and 206, act as wedge structures that press against sheet metal blanks in the forming tool. As described in greater detail below, a seal is formed between these wedge structures and the sheet metal blanks when the nozzle body 100 is inserted to a sealing position along the insertion direction "I."

Also shown in FIG. 2 is a conduit 212, which is defined through the nozzle body 100. In the specific and non-limiting example that is shown in FIG. 2, the conduit 212 is aligned parallel to the insertion direction "I" of the nozzle body. Further, the conduit 212 extends between the front face 104 and the rear face 106 of nozzle body 100, and is open at both ends. The conduit 212 is for conducting an expansion fluid through said nozzle body 100 and into a space between the plural sheet metal blanks in the forming tool during superplastic forming. For instance, not illustrated connectors and pressure tubing connect the conduit 212 of nozzle body 100 to a source of the pressurized fluid, such as for instance a source of pressurized air.

Figure 3:
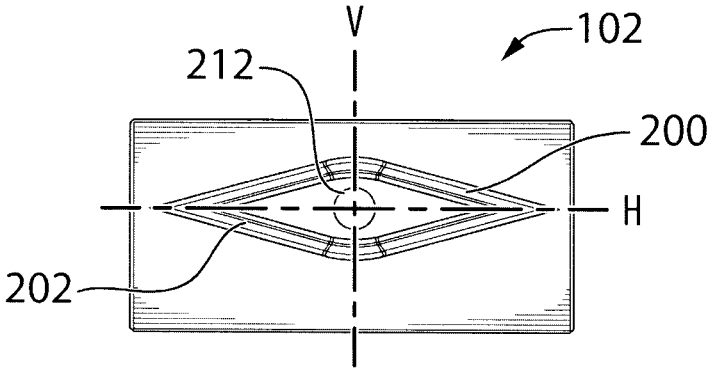
FIG. 3 is an end view showing the conduit opening located within a front face of the nozzle body of FIG. 1.

Referring to FIG. 3, the sealing portion 102 of nozzle body 100 has two mutually perpendicular planes of symmetry, a horizontal plane "H" and a vertical plane "V," which intersect along a line that is parallel to the insertion direction of the nozzle body 100. In the instant and non-limiting example that is shown in FIG. 3, the conduit 212 is approximately axially aligned along the line of intersection of the symmetry planes "H" and "V." Optionally, at least one of the relative size, shape and location of the conduit 212 is varied.

Figure 4:
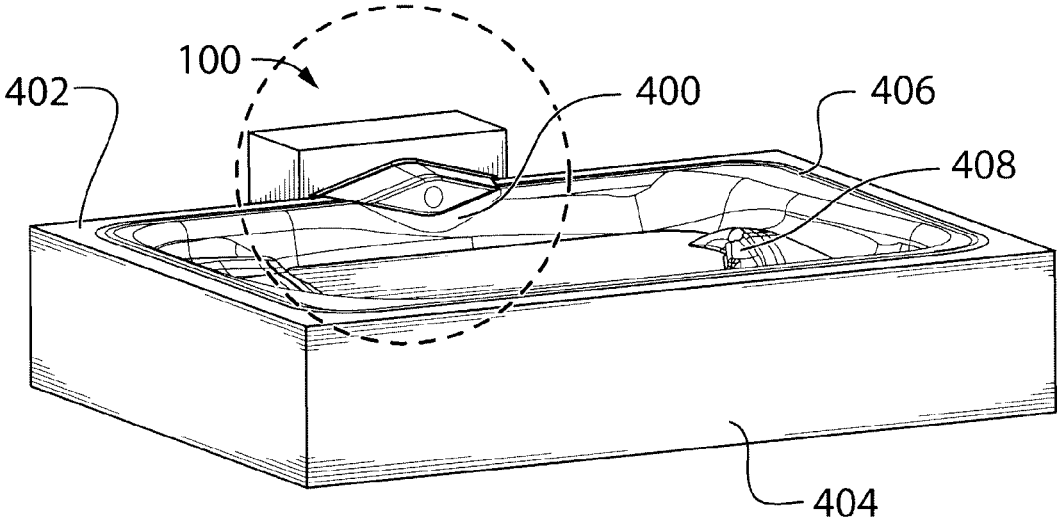
FIG. 4 is a perspective view showing the nozzle body of FIG. 1 within a recess along the edge region of a lower die.
Figure 5:
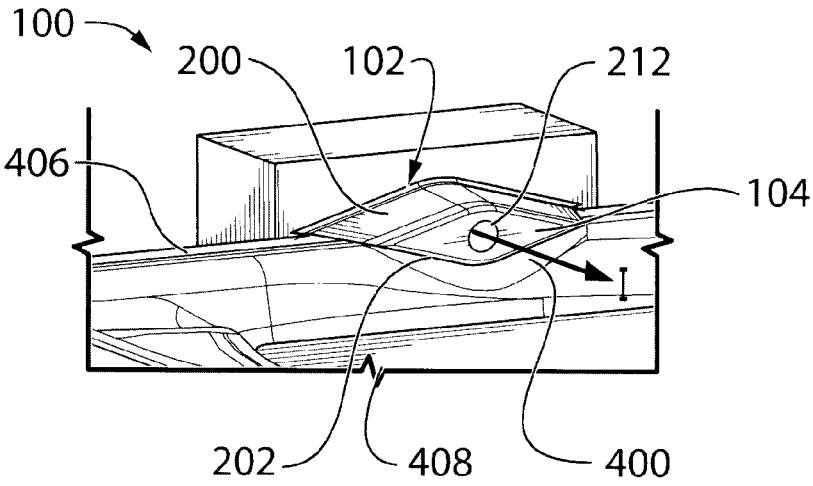
FIG. 5 shows enlarged detail within the dashed circle of FIG. 4.

FIG. 4 illustrates the nozzle body 100 of FIG. 1 disposed within a recess 400 that is formed along an edge region 402 of a lower die 404. For clarity, the first and second sheet metal blanks are not shown FIG. 4. A seal bead 406 extends around the edge region 402 of the lower die 404, and surrounds forming surfaces 408 that are located in a central region of the lower die 404. The seal bead 406 extends continuously through the recess 400, and as such it is hidden below the sealing portion 102 of the nozzle body 100 in the view that is shown in FIG. 4. Now with reference also to FIG. 5, it is to be noted that the shape of the recess 400 matches the shape of the sealing portion 102 of the nozzle body 100. More particularly, the recess 400 is substantially complementary to the shape of the second sealing surface 202. That is to say, the opposite edges of the recess 400 converge one toward the other along the insertion direction "I." Notably, neither the first sealing surface 200 nor the second sealing surface 202 of the nozzle body carries a seal bead; seals are formed between the sealing surface 202 and the seal bead 406, as well as between the sealing surface 200 and a seal bead on a not illustrated upper die. As is discussed in greater detail below, seals are also formed between each of the converging side edges 204 and 206 of the nozzle body 100 and the seal beads of the upper and lower dies.

Figure 6:
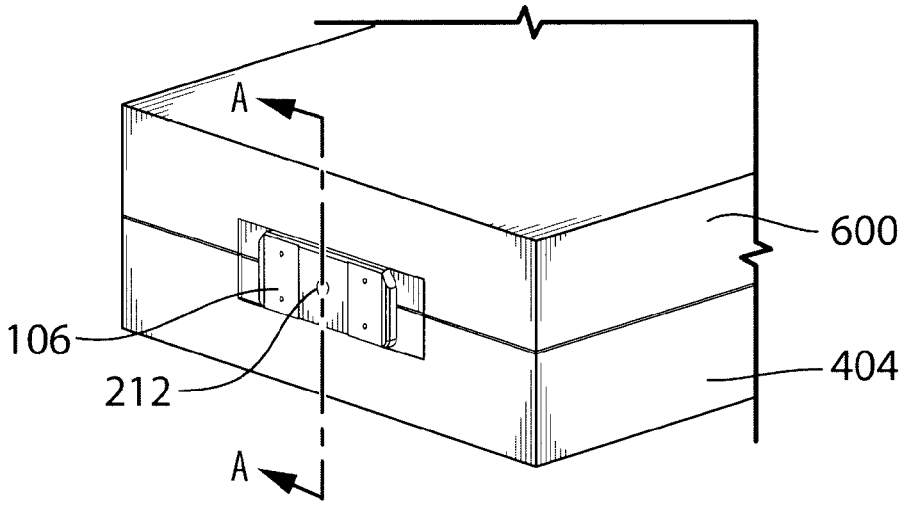
FIG. 6 is a perspective view showing the nozzle body of FIG. 1 inserted within a channel formed between an upper die and the lower die.
Figure 7:
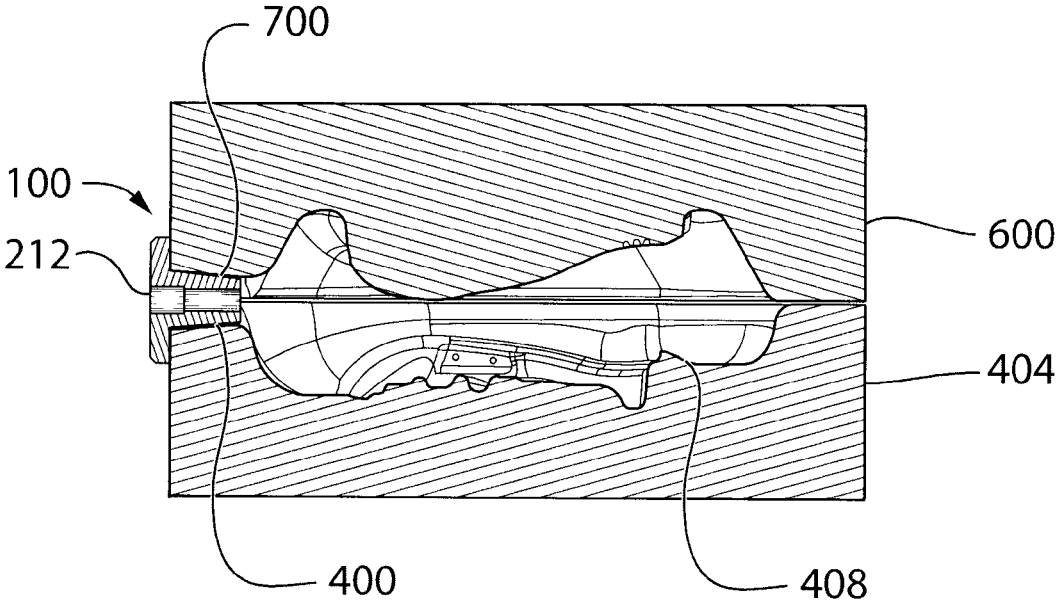
FIG. 7 is a cross sectional view showing the nozzle body of FIG. 1 inserted within the channel between the upper die and the lower die.
Figure 8:
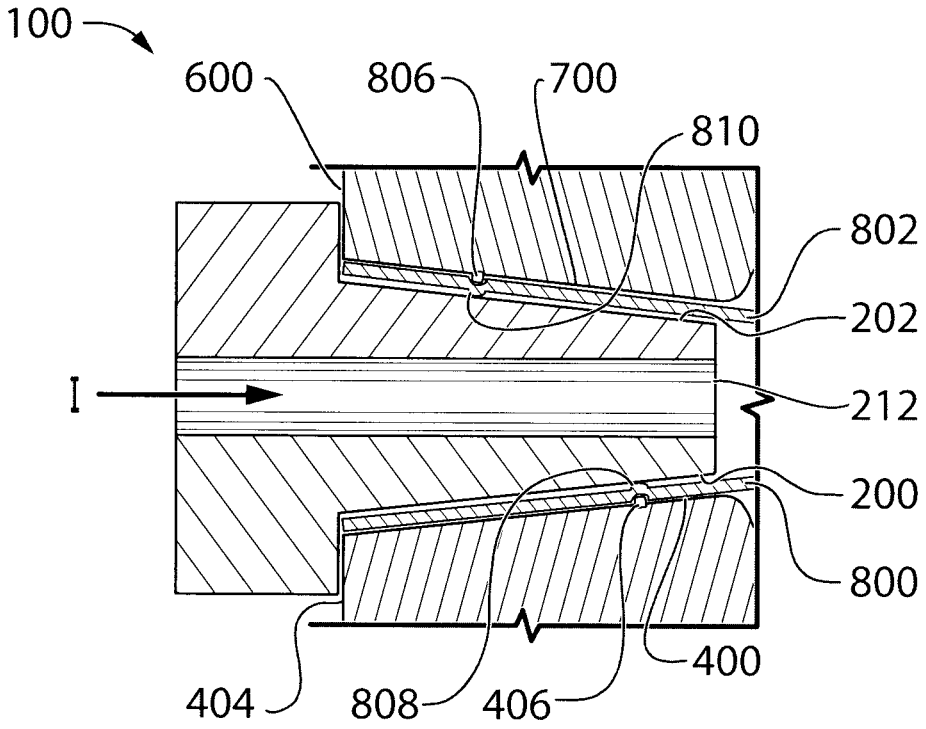
FIG. 8 is a cross sectional view showing enlarged detail of the seal formation along the first and second sealing surfaces when the nozzle body of FIG. 1 is inserted to a sealing position between sheet metal blanks in a forming tool.

FIG. 6 is a perspective view showing the nozzle body of FIG. 1 inserted within a channel that is formed between an upper die 600 and the lower die 404 of a forming tool. More particularly, the channel is formed when the upper die 600 and the lower die 404 are brought together into a closed condition, and the recess 400 in the lower die 404 is aligned with a corresponding recess in the upper die 600. FIG. 7 is a side cross-sectional side view of the assembly of FIG. 6, taken along the line A-A. For clarity, the first and second sheet metal blanks have been omitted, and as such they are not illustrated in FIG. 6 or 7. FIG. 8 shows an enlarged cross sectional view of the nozzle body 100 inserted into the channel between the upper and lower dies 404 and 600, respectively. In FIG. 8, first and second sheet metal blanks 800 and 802, respectively, are shown.

Referring particularly to FIG. 8, when the nozzle body 100 is inserted to a sealing position within the channel that is formed between the upper die 600 and the lower die 404, the first sealing surface 200 presses the first sheet metal blank 800 into sealing engagement with the seal bead 406 that extends along the surface 400 of the lower die 404, and the second sealing surface 202 presses the second sheet metal blank 802 into sealing engagement with a seal bead 806 that extends along the surface 700 of the upper die 600. As is shown in FIG. 8, the seal bead 406 is offset from the seal bead 806 along the insertion direction "I" of the nozzle body 100. In this way, a seal is formed between the first sealing surface 200 and the first blank 800, and a seal is formed between the second sealing surface 202 and the second blank 802. Referring once again to FIG. 2, the smoothly curved surface portions 208 and 210 of the first and second sealing surfaces 200 and 202, respectively, support the formation of seals along the entire first sealing surface 200 and along the entire second sealing surface 202.

Figure 9:
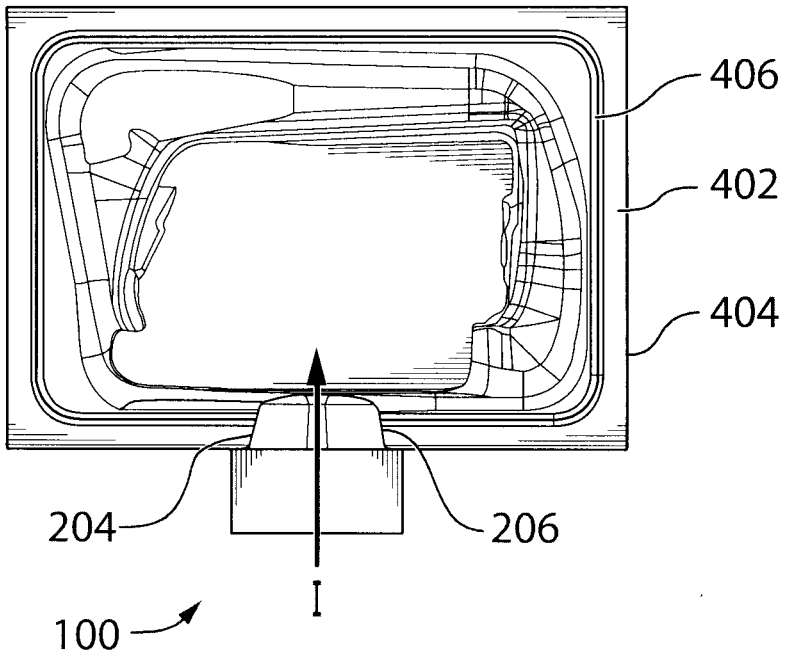
FIG. 9 is a top view showing the nozzle body of FIG. 1 within the recess along the edge region of the lower die.
Figure 10:
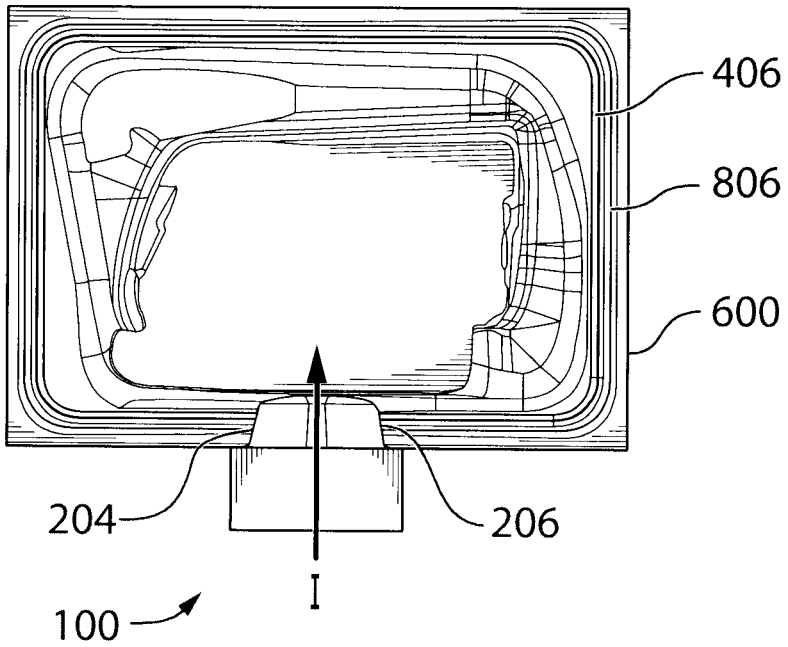
FIG. 10 is a top view showing the nozzle body of FIG. 1 inserted within the channel between the upper die and the lower die, with the upper die transparent.

Referring now to FIG. 9, shown is a top view of the nozzle body 100 disposed within the recess along the edge region 402 of the lower die 404. FIG. 10 is a top view showing the nozzle body 100 inserted into the channel between the upper die 600 and the lower die 404, in which the features of the upper die 600 are transparent in order to facilitate discussion. As will be apparent, in order to perform superplastic forming it is necessary to form a peripheral seal around the entire perimeter of the first and second sheet metal blanks 800 and 802, respectively. The offset seal beads 406 and 806, as shown most clearly in FIG. 10, form a double seal around the perimeter of the sheet metal blanks (blanks not illustrated in FIGS. 9 and 10). In particular, the seal beads 406 and 806 press the edges of the sheet metal blanks together such that a seal is formed between the edges of the sheet metal blanks. Further, as is discussed above with reference to FIG. 8, the portions of the seal beads 406 and 806 that extend into and through the channel between the lower die 404 and the upper die 600 press and seal the edges of the first and second sheet metal blanks 800 and 802 against the first and second sealing surfaces 200 and 202 of the nozzle body 100, respectively.

Now with reference only to FIGS. 9 and 10, the mechanism for sealing along the opposite side edges 204 and 206 of the nozzle body 100 will be discussed. Sealing along the opposite side edges 204 and 206 is complicated by the fact that the nozzle body 100 is disposed between the sheet metal blanks 800 and 802. Necessarily, the sheet metals blanks 800 and 802 are spaced apart one from the other in order to accommodate the nozzle body within the channel. The problem of sealing a space between the surfaces of two sheet metal blanks and the nozzle body is solved with the use of a nozzle body that is tapered in two directions, as described with reference to FIG. 2, such that the opposite side edges 204 and 206 of the nozzle body 100 converge one toward the other along the insertion direction "I" of the nozzle body. As is shown most clearly in FIGS. 9 and 10, the portion of the nozzle body 100 that is received within the channel between the lower die 404 and the upper die 600 appears generally wedge-shaped in top view.

When the nozzle body 100 is advanced along the insertion direction "I" into the channel between the lower die 404 and the upper die 600, as is shown in FIG. 10, then the opposite side edges 204 and 206 press the sheet metal blanks 800 and 802 against the seal beads 406 and 806, respectively, along both sides of the nozzle body 100. In particular, the opposite side edges 204 and 206 press the sheet metal blank 800 against the seal bead 406 with a force having a first component along the insertion direction "I" and having a second component along a direction that is normal to the insertion direction "I." Similarly, the opposite side edges 204 and 206 press the sheet metal blank 802 against the seal bead 806 with a force having a first component along the insertion direction "I" and having a second component along a direction that is normal to the insertion direction "I." In this way, a seal is formed between the first sealing surface 200 of the nozzle body 100 and the first sheet metal blank 800, the seal extending past the opposite side edges 204 and 206 of the nozzle body 100, and then continuing between the sheet metal blanks 800 and 802. In the same way, a seal is formed between the second sealing surface 202 of the nozzle body 100 and the second sheet metal blank 802, the seal extending past the opposite side edges 204 and 206 of the nozzle body 100, and then continuing between the sheet metal blanks 800 and 802. As such, a seal around the entire perimeter of the sheet metal blanks 800 and 802 is established, the seal capable of withstanding the high temperatures and high internal fluid pressures that occur during superplastic forming of shaped articles from the sheet metal blanks 800 and 802. Optionally, the two shaped articles are identical or the two shaped articles are different.

The system that is described above with reference to FIGS. 1 to 10 provides increased process throughput, compared to traditional SPF processes, due to the simultaneous forming of two sheet metal blanks utilizing both the upper die and the lower die for independent part shapes. A method for the forming of first and second shaped articles from first and second sheet metal blanks, using the SPF process, is described with reference to FIG. 11. At 1100 the first sheet metal blank is arranged on the lower die of a forming tool, such that a peripheral region of the first sheet metal blank contacts a first seal bead that extends around an edge surface of the lower die. The first sheet metal blank is further arranged such that it overlaps with a first recess that is defined within the edge surface of the lower die. At 1102 a nozzle body is positioned above the first sheet metal blank and in alignment with the first recess. At 1104 the second sheet metal blank is arranged on top of the first sheet metal blank in the forming tool. At 1106 the forming tool is closed, such as by relatively moving an upper die of the forming tool in a direction toward the lower die. When in the closed condition, a second seal bead that extends around an edge surface of the upper die contacts a peripheral region of the second sheet metal blank. Further, a second recess defined within the edge surface of the upper die is aligned with the first recess of the lower die, such that the first recess and the second recess cooperate to form a channel for receiving the nozzle body. At 1108 a tonnage is applied to the upper and lower dies, which are pre-heated to the superplastic forming temperature of the first and second sheet metal blanks, so as to conform the first and second sheet metal blanks against opposite sealing surfaces of the nozzle body within the channel. At 1110 the nozzle body is advanced within said channel along an insertion direction between said first and second sheet metal blanks. In particular, the nozzle body is advanced to a sealing position, and is then maintained in the sealing position by the application of a force to the support portion. At 1112 a pressurized fluid is introduced via a conduit that is defined through said nozzle body, and enters into a space between the first and second sheet metal blanks. At 1114 the first and second shaped articles are formed simultaneously, under superplastic forming (SPF) conditions, by forcing the first and second sheet metal blanks against forming surfaces of the upper and lower dies, respectively. Subsequently, the tool is opened and the nozzle body is retracted to allow for double part removal. The first and second shaped articles are removed, and trimmed as necessary, etc. Optionally, the tonnage that is applied at step 1108 is a partial tonnage and the nozzle is advanced at step 1110 under the partial tonnage. Subsequently, the operating tonnage is applied prior to introducing the pressurized fluid. Alternatively, the tonnage that is applied at step 1108 is the operating tonnage.

Figure 11:
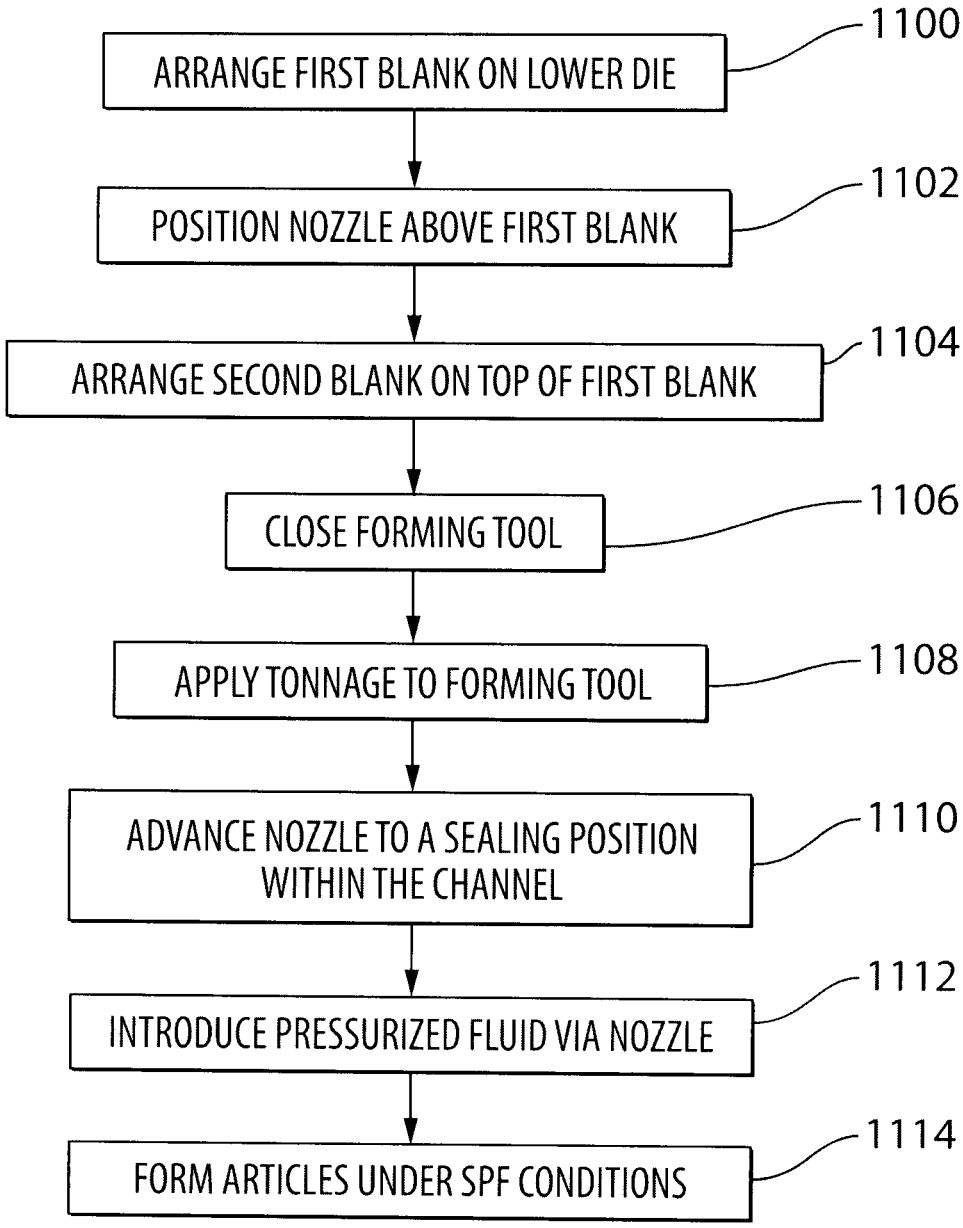
FIG. 11 is a simplified flow diagram of a method for forming first and second shaped articles from first and second sheet metal blanks, according to an embodiment of the instant invention.

In the method that is described with reference to FIG. 11, the first and second seal beads are offset one from the other, and the nozzle body has first and second sealing surfaces that are joined along opposite side edges thereof. The opposite side edges converge one toward the other along the insertion direction, and the channel formed between the dies is shaped such that, when the nozzle body is inserted into the channel and to the sealing position, the first seal bead forms a seal between the first sheet metal blank and each side edge of said nozzle body, and the second seal bead forms a seal between the second sheet metal blank and each side edge of said nozzle body.

While the above description constitutes a plurality of embodiments of the present invention, it will be appreciated that the present invention is susceptible to further modification and change without departing from the fair meaning of the accompanying claims.

What is claimed is:

1. An apparatus for forming first and second shaped articles from first and second sheet metal blanks, comprising:

a first die having first forming surfaces for forming the first shaped article from the first sheet metal blank and having a first seal bead disposed along an edge region surrounding said first forming surfaces, the first seal bead for peripherally sealing between the first die and the first sheet metal blank, the first die having a first recess defined in the edge region thereof, the first seal bead extending along a first surface through the first recess;

a second die having second forming surfaces for forming the second shaped article from the second sheet metal blank and having a second seal bead disposed along an edge region surrounding said second forming surfaces, the second seal bead for peripherally sealing between the second die and the second sheet metal blank, the second die having a second recess defined in the edge region thereof, the second seal bead extending along a second surface through the second recess; and a nozzle body having a conduit extending therethrough for conducting an expansion fluid through said nozzle body, the nozzle body shaped for being received within a channel that is formed when the first die and the second die are brought together into a closed condition such that the first recess and the second recess are aligned one with the other, said nozzle body having first and second sealing surfaces that are joined along opposite side edges of said nozzle body, said opposite side edges converging one toward the other along an insertion direction of said nozzle body, wherein the channel is shaped such that, when the nozzle body is inserted along the insertion direction to a sealing position within the channel, the first seal bead forms a seal between the first sheet metal blank and each side edge of said nozzle body, and the second seal bead forms a seal between the second sheet metal blank and each side edge of said nozzle body.

2. The apparatus of claim 1 wherein the nozzle body comprises a generally diamond-shaped front face, and wherein the conduit extends through the nozzle body to an opening that is defined in the front face.

3. The apparatus of claim 1 wherein the conduit extends through the nozzle body along the direction of insertion.

4. The apparatus of claim 1 wherein a spacing between the first and second sealing surfaces increases from a minimum spacing value along each of the side edges to a maximum spacing value approximately half-way between said opposite side edges.

5. The apparatus of claim 4 wherein each one of the first and second sealing surfaces comprises a smoothly curved surface portion approximately half way between said opposite edges.

6. The apparatus of claim 5 wherein the nozzle body has two mutually perpendicular planes of symmetry intersecting along a line that is parallel to the insertion direction.

7. The apparatus of claim 6 wherein the conduit is approximately axially aligned with said line along the intersection of the two mutually perpendicular planes of symmetry.

8. The apparatus of claim 1 wherein the first shaped article is different than the second shaped article.

9. The apparatus of claim 1 wherein the first die and the second die together form a cavity in the closed condition, and wherein the channel opens into the cavity from the exterior of the apparatus.

10. An apparatus for forming first and second shaped articles from first and second sheet metal blanks, comprising:

a nozzle body having an upper sealing surface and a lower sealing surface, the upper and lower sealing surfaces being joined along opposite side edges of said nozzle body, the opposite side edges converging one toward the other along an insertion direction of said nozzle body, said nozzle body having a conduit extending therethrough for conducting an expansion fluid through said nozzle body; and a pair of dies, each die of said pair of dies having part forming surfaces and having a seal bead disposed along an edge region surrounding said forming surfaces, the seal bead of one of said dies being offset relative to the seal bead of the other of said dies, the one of said dies having a first recess defined in the edge region thereof and the other of said dies having a second recess defined in the edge region thereof, the seal bead of the one of said dies extending along a surface through said first recess and the seal bead of the other of said dies extending along a surface through the second recess, said dies being relatively moveable between opened and closed positions with respect to one another, and said first recess being aligned with said second recess such that, in the closed position, the first recess and the second recess cooperate to form a channel for receiving said nozzle body, said channel having opposite edges, each opposite edge of said channel extending along a seam that is defined between the surface of the first recess and the surface of the second recess, the opposite edges of said channel converging one toward the other along the insertion direction of said nozzle body, wherein, during use, said nozzle body is disposed between said first and second sheet metal blanks within said channel, the seal bead of the one die forming a seal between the first sheet metal blank and the upper sealing surface of said nozzle body, and the seal bead of the other die forming a seal between the second sheet metal blank and the lower sealing surface of said nozzle body, and wherein, during use, the seal bead of the one die forms a seal between the first sheet metal blank and each side edge of said nozzle body, and the seal bead of the other die forms a seal between the second sheet metal blank and each side edge of said nozzle body.

11. The apparatus of claim 10 wherein the nozzle body comprises a generally diamond-shaped front face, and wherein the conduit extends through the nozzle body to an opening that is defined in the front face.

12. The apparatus of claim 10 wherein the conduit extends through the nozzle body along the direction of insertion.

13. The apparatus of claim 10 wherein a spacing between the first and second sealing surfaces increases from a minimum spacing value along each of the side edges to a maximum spacing value approximately half-way between said opposite side edges.

14. The apparatus of claim 13 wherein each one of the first and second sealing surfaces comprises a smoothly curved surface portion approximately half way between said opposite edges.

15. The apparatus of claim 14 wherein the nozzle body has two mutually perpendicular planes of symmetry intersecting along a line that is parallel to the insertion direction.

16. The apparatus of claim 15 wherein the conduit is approximately axially aligned with said line along the intersection of the two mutually perpendicular planes of symmetry.

17. The apparatus of claim 10 wherein the first shaped article is different than the second shaped article.

18. The apparatus of claim 10 wherein the pair of dies together forms a cavity in the closed position, and wherein the channel opens into the cavity from the exterior of the apparatus.

19. The apparatus of claim 10 wherein the opposite edges of the channel converge at a same rate as the opposite side edges of the nozzle body, such that when the nozzle body is inserted into the channel along the insertion direction, each side edge of the nozzle body presses the respective sheet metal blank onto the respective seal bead with a force having a first component along the insertion direction and having a second component perpendicular to the insertion direction.

20. A method for forming first and second shaped articles from first and second sheet metal blanks, comprising:

arranging the first sheet metal blank on a lower die of a forming tool, such that a peripheral region of the first sheet metal blank contacts a first seal bead that extends around an edge surface of the lower die, and such that the first sheet metal blank overlaps with a first recess defined within the edge surface of the lower die;

positioning a nozzle body above the first sheet metal blank and in alignment with the first recess;

arranging the second sheet metal blank on top of the first sheet metal blank;

closing the forming tool, comprising relatively moving an upper die of the forming tool in a direction toward the lower die, such that a second seal bead that extends around an edge surface of the upper die contacts a peripheral region of the second sheet metal blank, and such that a second recess defined within the edge surface of the upper die is aligned with the first recess of the lower die, the first recess and the second recess cooperating to form a channel for receiving the nozzle body;

applying a tonnage to the upper and lower dies, so as to conform the first and second sheet metal blanks against opposite sealing surfaces of the nozzle assembly within the channel;

advancing the nozzle body along an insertion direction between said first and second sheet metal blanks;

introducing pressurized fluid via a conduit that is defined through said nozzle body and into a space between the first and second sheet metal blanks; and forming the first and second shaped articles simultaneously, under superplastic forming conditions, by forcing the first and second sheet metal blanks against forming surfaces of the upper and lower dies, respectively;

wherein said first and second seal beads are offset one from the other, said nozzle body has first and second sealing surfaces that are joined along opposite side edges thereof, said opposite side edges converging one toward the other along the insertion direction, and the channel is shaped such that, when the nozzle body is inserted into the channel along the insertion direction, the first seal bead forms a seal between the first sheet metal blank and each side edge of said nozzle body, and the second seal bead forms a seal between the second sheet metal blank and each side edge of said nozzle body.

21. The method of claim 20 wherein advancing the nozzle comprises advancing the nozzle along the insertion direction to a sealing position within the channel.

22. The method of claim 20 wherein applying the tonnage comprises applying a predetermined operating tonnage for effecting a peripheral seal between the first and second sheet metal blanks.

23. The method of claim 20 wherein applying the tonnage comprises applying a partial tonnage less than a predetermined operating tonnage for effecting a peripheral seal between the first and second sheet metal blanks, and further comprising applying the predetermined operating tonnage subsequent to advancing the nozzle and prior to introducing pressurized fluid.

24. The method of claim 20 wherein the first shaped article is different than the second shaped article.

25. The method of claim 20 wherein, during advancing the nozzle body along the insertion direction between said first and second sheet metal blanks, said opposite side edges of said nozzle body press the first and second sheet metal blanks against the first and second seal beads, respectively, with a force having a first component directed along the insertion direction and having a second component directed perpendicular to the insertion direction.

* * * * *